US008484937B1

(12) United States Patent
Gabriel

(10) Patent No.: US 8,484,937 B1
(45) Date of Patent: Jul. 16, 2013

(54) METHODS FOR SEALING OVERLAPPED FLEXIBLE PACKAGING MATERIAL USING AN ELECTRICAL IMPULSE THROUGH A CONDUCTIVE ELEMENT

(75) Inventor: Michael J. Gabriel, Inver Grove Heights, MN (US)

(73) Assignee: Land O'Lakes, Inc., Arden Hills, MN (US)

( * ) Notice: Subject to any disclaimer, the term of this patent is extended or adjusted under 35 U.S.C. 154(b) by 560 days.

(21) Appl. No.: 12/728,438

(22) Filed: Mar. 22, 2010

Related U.S. Application Data

(60) Provisional application No. 61/162,797, filed on Mar. 24, 2009.

(51) Int. Cl.
*B65B 7/04* (2006.01)

(52) U.S. Cl.
USPC ..... 53/479; 53/463; 53/469

(58) Field of Classification Search
USPC ..... 53/479, 463, 477
See application file for complete search history.

(56) References Cited

U.S. PATENT DOCUMENTS

| | | | | | |
|---|---|---|---|---|---|
| 2,259,866 | A | * | 10/1941 | Stokes | 53/415 |
| 2,294,220 | A | * | 8/1942 | Albertson | 53/415 |
| 3,381,442 | A | * | 5/1968 | Paxton | 53/410 |
| 3,661,322 | A | * | 5/1972 | Norman | 383/107 |
| 3,861,120 | A | * | 1/1975 | Gordon | 53/230 |
| 3,958,390 | A | * | 5/1976 | Pringle, Jr. et al. | 53/433 |
| 4,353,196 | A | * | 10/1982 | Beer et al. | 53/451 |
| 4,393,759 | A | | 7/1983 | Quilliou et al. | |
| 4,467,589 | A | * | 8/1984 | van Maanen | 53/450 |
| 4,472,339 | A | | 9/1984 | van der Ploeg et al. | |
| 4,546,595 | A | * | 10/1985 | Yasumune et al. | 53/450 |
| 4,630,429 | A | * | 12/1986 | Christine | 53/479 |
| 4,663,915 | A | * | 5/1987 | Van Erden et al. | 53/450 |
| 4,706,298 | A | * | 11/1987 | Lipes et al. | 383/71 |
| 4,715,166 | A | * | 12/1987 | Kameda | 53/550 |
| 4,726,171 | A | * | 2/1988 | Kreager et al. | 53/410 |
| 4,792,457 | A | * | 12/1988 | Brna et al. | 426/574 |
| 4,807,426 | A | * | 2/1989 | Smith | 53/550 |

(Continued)

FOREIGN PATENT DOCUMENTS

| | | | |
|---|---|---|---|
| GB | 905450 | A | 9/1962 |
| GB | 1127819 | A | 9/1968 |
| GB | 1177800 | A | 1/1970 |
| WO | 9406304 | A | 3/1994 |

OTHER PUBLICATIONS

Traco Manufacturing, Inc., Super Sealer Shrink Wrap System, Owner's Guide, 9 pages, 2006-2009.

*Primary Examiner* — Hemant M Desai
*Assistant Examiner* — Gloria R Weeks
(74) *Attorney, Agent, or Firm* — Dorsey & Whitney LLP; Bridget M. Hayden, Esq.

(57) ABSTRACT

This disclosure relates to foiiuing food packages with a lap seal. A continuous, peelable hermetic seal is formed by activating a conductive element to emit an electrical impulse while contacting the overlap region of a pouch. The overlap is sealed by the heat generated from the activation of the conductive element, for example a wire. The conductive element is placed longitudinally along the overlap area of the pouch, which results in a sealed line. A second parallel sealed line may also be made to add redundancy, thereby better sealing the pouch. The disclosed method results in a package with an unsealed flap between first seal line and the film edge that allows for easy opening of the pouch.

17 Claims, 11 Drawing Sheets

U.S. PATENT DOCUMENTS

| | | | | | |
|---|---|---|---|---|---|
| 4,876,842 | A | * | 10/1989 | Ausnit | 53/410 |
| 4,907,393 | A | * | 3/1990 | Omori et al. | 53/410 |
| 5,053,239 | A | * | 10/1991 | Vanhatalo et al. | 426/412 |
| 5,078,509 | A | * | 1/1992 | Center et al. | 383/88 |
| 5,215,380 | A | * | 6/1993 | Custer et al. | 383/203 |
| 5,284,002 | A | * | 2/1994 | Fowler et al. | 53/412 |
| 5,347,792 | A | | 9/1994 | Meli et al. | |
| 5,447,012 | A | * | 9/1995 | Kovacs et al. | 53/433 |
| 5,538,590 | A | * | 7/1996 | Riley | 156/583.2 |
| 5,682,732 | A | * | 11/1997 | Selberg | 53/477 |
| 5,806,280 | A | * | 9/1998 | Su | 53/412 |
| 5,945,145 | A | * | 8/1999 | Narsutis et al. | 426/123 |
| 5,984,088 | A | * | 11/1999 | Dietz et al. | 206/205 |
| 6,250,048 | B1 | * | 6/2001 | Linkiewicz | 53/451 |
| 6,254,911 | B1 | * | 7/2001 | Komatsu | 426/393 |
| 6,265,002 | B1 | * | 7/2001 | Blatter | 426/108 |
| 6,302,027 | B1 | * | 10/2001 | Compton et al. | 102/323 |
| 6,339,912 | B1 | * | 1/2002 | Fahs et al. | 53/412 |
| 6,539,688 | B2 | * | 4/2003 | Fahs et al. | 53/412 |
| 6,764,576 | B1 | * | 7/2004 | Heinonen et al. | 156/379.7 |
| 7,323,665 | B2 | * | 1/2008 | Sperry et al. | 219/549 |
| 8,181,433 | B2 | * | 5/2012 | Kring, Jr. | 53/469 |
| 2002/0005026 | A1 | * | 1/2002 | Neri | 53/399 |
| 2002/0083681 | A1 | * | 7/2002 | Fahs et al. | 53/412 |
| 2003/0090026 | A1 | | 5/2003 | Rasmussen | |
| 2003/0213216 | A1 | * | 11/2003 | Harte et al. | 53/510 |
| 2004/0040261 | A1 | * | 3/2004 | Troyer et al. | 53/451 |
| 2007/0127853 | A1 | * | 6/2007 | Bezek et al. | 383/38 |
| 2008/0312056 | A1 | * | 12/2008 | Selle et al. | 493/197 |

* cited by examiner

METHODS FOR SEALING OVERLAPPED FLEXIBLE PACKAGING MATERIAL USING AN ELECTRICAL IMPULSE THROUGH A CONDUCTIVE ELEMENT

CROSS-REFERENCE TO RELATED APPLICATION

The present application is based on and claims the benefit of U.S. provisional patent application Ser. No. 61/162,797, filed Mar. 24, 2009, the content of which is hereby incorporated by reference in its entirety.

BACKGROUND

Many processed cheese and cream cheese manufacturers utilize horizontal pouch forming, filling, and sealing equipment from American National Can Company or Hart Design and Manufacturing. Conventional processes use wax coated film (usually cellophane or PET based) to form pouches that are then filled with a food product such as cheese. After filling, the pouches are closed by over-lapping the film that wraps around the product and sealing the films together in the over-lapped area. Waxed film layers are easily sealed together with heat because of the wax's low melt initiation temperature and its excellent flow and caulking properties. A wax lap seal is usually achieved by the heat of the molten cheese product (typically about 165° F.) alone. However, waxed films are relatively expensive. Moreover, they have a tendency to delaminate when the pouch is opened, so that the wax layer pulls away from the film substrate and sticks to the food surface.

Currently, most horizontal pouch forming equipment, when using non-wax film such as a polymeric film, requires the formation of a "fin seal." A fin seal has edges of superimposed films bonded to each other, resulting in a pouch having a fin-like protuberance. A fin seal requires a wider film width to make the fin, thus requiring more material per pouch and also tending to require considerably slower line speeds to properly facilitate the sealing of the fin seal. Moreover, a high cost is associated with retrofitting older lap folding equipment to provide for formation of a fin seal.

SUMMARY OF THE INVENTION

A continuous, peelable hermetic seal is formed by sending an electrical impulse through a conductive element to generate heat while contacting the overlap area of a pouch. The overlap is sealed by placing an impulse sealer wire longitudinally along the overlap and activating the wire to produce heat, which results in a sealed line. In an exemplary embodiment, a second parallel sealed line may also be made to add redundancy, thereby better sealing the pouch. The disclosed method results in an unsealed flap between the first seal line and the film edge. This unsealed flap allows for easy opening of the pouch, as the user has adequate space for gripping the flap and pulling up on the film to break the seal. Because heat is applied to only very narrow areas of film, specifically only at the seal lines, there is virtually no distortion or wrinkling of the film. Moreover, significant energy savings may be achieved by heating only the very thin conductive elements and only for short electrical impulses.

In a first aspect, the present disclosure relates to a method of forming a lap seal. The method includes placing a tamper having at least one conductive element along overlapping film layers of a pouch and activating the conductive element to emit an electrical impulse to form a seal line. The conductive element is preferably a wire and is about 0.25 inch in diameter or smaller in an exemplary embodiment. The tamper is placed longitudinally along the pouch top edge in an exemplary embodiment. The method may also include a tamper that includes a second conductive element wherein activation forms two seal lines. The lap seal is generally formed on a food pouch. An unsealed flap formed from the film edge of the overlap to the first seal line may be lifted to open the package when desired.

In another aspect, the present disclosure relates to a method of packaging food comprising placing a pouch in an enclosure, filling the pouch with food product and sealing the pouch with an electrical impulse emitted by a conductive element while in contact with an overlapping region of the pouch. The method may include sealing at a sealing station comprising a tamper having the conductive element, wherein the tamper is placed on the top edge of the pouch prior to emission of the electrical impulse. The method may also include folding at a folding station after filling the pouch with food product. The folding station may include one or more sweeper arms with a roller and one or more rocker arms.

In a further aspect, the present disclosure relates to a food package comprising a pouch having a lap seal wherein the seal comprises at least one seal line generated by an electrical impulse going through the overlap area of the pouch. The package seal may also include a second seal line parallel to the first seal line in the overlap area of the pouch. The package may also include an unsealed flap between the film edge and the first seal line. The package may be produced in a line production system. In an exemplary embodiment, the food package contains food product such as cheese and cheese products.

In yet another aspect, the present disclosure relates to a food packaging conveyor system. The system includes a pouch sealing station comprising a tamper having on its bottom surface one or more conductive elements capable of emitting an electrical impulse. The system may also include controls for activation of emissions of electrical impulses while the tamper is disposed upon the overlapping edges of a pouch that results in one or more seal lines on the pouch. The system may include conductive elements that are wires; the tamper may include two conductive elements. The system may also include a conveying system for conveying enclosures and a pouch insertion station wherein pouches are inserted into the enclosures. A pouch filling station may also be included for loading food product into the pouches. The pouch folding station may include means for folding the top edges of pouches over the food product to produce overlapping layers at the top edge of the pouch.

BRIEF DESCRIPTION OF THE DRAWINGS

The disclosed subject matter will be further explained with reference to the attached figures, wherein like structure or system elements are referred to by like reference numerals throughout the several views.

Figure 1:
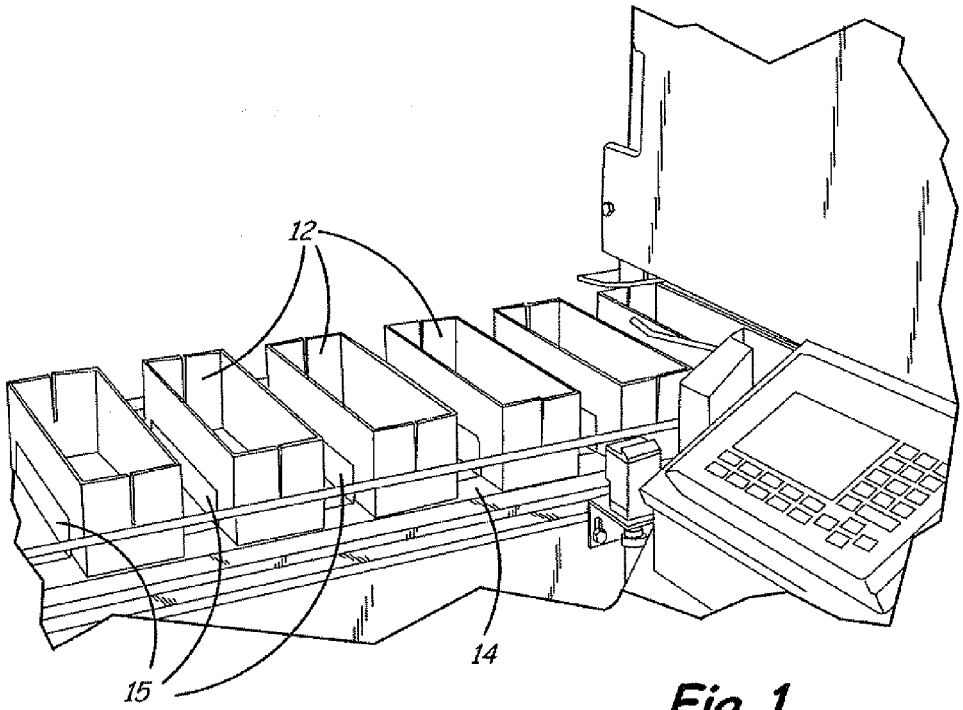
FIG. 1 is a perspective view of a plurality of cartons on a conveyer.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. Moreover, where terms such as above, below, over, under, top, bottom, side, right, left, etc., are used, it is to be understood that they are used only for ease of understanding the description. It is contemplated that structures may be otherwise oriented.

DETAILED DESCRIPTION OF ILLUSTRATIVE EMBODIMENTS

The present invention relates to the use of a conductive element, such as a wire, to seal food packages, resulting in a package with a lap seal. The conductive elements can be, for example, on the bottom surface of a tamper. When the tamper with the conductive element(s) is placed on the overlapping layers of a pouch and activated, an electrical impulse is discharged through the conductive element and sufficient heat is generated by the conductive element to produce a lap seal in the overlapping layers of the pouch. The lap seal produced can include one or more seal lines as a result of the heated conductive element(s). This method of sealing is advantageous because the seal line provides a tight seal yet can be easily opened by the end user when desired. It is also amenable to a production line system and results in cost savings due to the low amounts of heat used intermittently.

In exemplary embodiments, this method is used for pouches made from polymeric film and does not result in distortion or wrinkling of the film due to the low amount of heat used. The ability to use a non-wax film without a fin seal results in considerable materials savings due to less film being required per package. Further, no costly retrofitting of equipment is needed for lap sealing capabilities. Moreover, increased production results from faster line speeds. In one exemplary embodiment, a non-wax-coated, polymeric film is used in 5 pound and 2 pound processed cheese packaging operations. A finished block of wrapped cheese is sometimes referred to as a "loaf."

"Lap seal" as used herein refers to the type of seal found on packages or pouches in which a film is wrapped around a food product and edges of the film overlap over the food product. A seal is formed in the overlapping region of the package.

The present disclosure includes a food package in which the pouch has a lap seal that can include one or more seal lines. In one embodiment, this disclosure relates to a pouch that utilizes a lap sealable polymer packaging film with no wax component. A variety of polymer film packages are available and all are within the scope of this invention. In an exemplary embodiment, the film is used on horizontal pouch foaming, filling and sealing equipment that packages processed cheeses and other variable viscosity foods and ingredients. Particularly suitable equipment is available from, for example, American National Can Company, Chicago, Ill. and Hart Design and Manufacturing, Green Bay, Wis.

An exemplary film is a 3 mil thick, 3-layer film available from Alcan Packaging, Minneapolis, Minn. The first layer is composed of oriented polypropylene (OPP). A thin layer of polyurethane adhesive laminates the OPP layer to a sealant layer having glycerol monostearate (GMS) blended into an ethylene vinyl acetate-polybutylene (EVA-PB) and polyethylene sealant for enhanced cheese release properties. This film exhibits even better release properties if it has been allowed to cure for several weeks after manufacture and before use. In exemplary embodiments, the film did not exhibit tacking issues in the pouch gusset area. This sealant resin blend possesses a relatively low heat activation temperature (successfully sealing at about 220° F.). This film possesses adequate stiffness, a pouch formed therefrom flares properly in a carton, the pouch stays in the carton as an insertion ram exits, and the pouch travels to the filling area satisfactorily. An exemplary embodiment has a 14.875" printed eyespot fiducial repeat pattern.

The pouch may be formed in a variety of ways. The pouch may be purchased as a preformed article and then used for filling with the desired food product. Alternatively, the pouch may be formed separately or as part of a production line conveyance system used for packaging the food product.

In an exemplary embodiment, a pouch is formed from film roll stock material. The film runs through a former that folds the film to form a bottom gusset. In an exemplary embodiment, a pouch has a length of about 14 to 15 inches. The folded film moves into a pneumatic heat sealing station, where end seals are placed onto the pouch. In an exemplary embodiment, the sealing assembly is activated through the use of pneumatically driven seal jaws that offer variability in jaw dwell time. In an exemplary embodiment, compression washers are used on both sides of the sealing jaws to equalize sealing pressure on both sides of the jaw face. An exemplary embodiment includes regions of greater pressure at the bottoms of the jaw faces to ensure adequate sealing at the bottom of food pouches. In an exemplary embodiment, the seal jaw back plate is made of silicone rubber.

Some embodiments use current "pancake style" metal sealing jaws. The heating jaw plates are held by a pancake assembly that allows seal adjustment up and down as well as adjustments in pouch length. Shimming the sealing jaws can improve the sealing pressures obtained on the end seals. In an exemplary embodiment, the jaws are shimmed a total of 0.035 inch. The jaws thus shimmed have more consistent and even sealing pressure and allow for the use of lower sealing temperatures. In other embodiments, older "scissors" type sealing jaws are used. The spring loaded pressures exhibited by the scissors jaws help provide for uniform sealing pressure on the end seals.

In an exemplary embodiment, the sealing jaw assembly has four heating zones that can be individually controlled for temperature and pressure: the top and bottom of each of the pair of jaws comprise individual zones. In an exemplary method, the top zones are heated to a higher temperature than the bottom zones. This is because higher temperatures are generally desirable to produce adequate end seals. However, lower temperatures are desirable in the bottom zones because that is where a gusset of the pouch is formed; if temperatures in the bottom zone are too high, the film sticks to itself in a phenomenon called "gusset tacking," thereby preventing the pouch from opening.

After the end seals are applied, the film web moves to a "V" notcher, where a "V"-shaped notch is cut into the film web between pouches to facilitate forming and folding pouches downstream in production. A 1.5 inch deep V-notch is particularly suitable for providing a combination of folding and machineability.

The pouch is cut off by a guillotine knife at its proper length and held in place by servo controlled vacuum plates. Servo driven nip rolls pull the pouches into the pouch inserter area. As a pouch is fed out over the opener/inserter, it is held by a set of vacuum jaw plates. The pneumatic/cam driven plunger ram then drives the open pouches into corrugated trays or cartons.

FIGS. 1-8 provide illustrations of an exemplary food package production system and are described in more detail below. The food packaging conveyor system may include a conveying system for conveying enclosures. FIG. 1 is a perspective view of a plurality of cartons 12 on a conveyer 14. Enclosures such as corrugated trays, boxes or cartons, formed in another area of the plant, are conveyed to the pouch inserter area. In an exemplary embodiment, cartons 12 are pushed onto conveyor 14 by line pressure. A backlog sensor stops cartons 12 from feeding in case of a backlog. Brackets 15 keep cartons 12 properly spaced and oriented.

Figure 2:
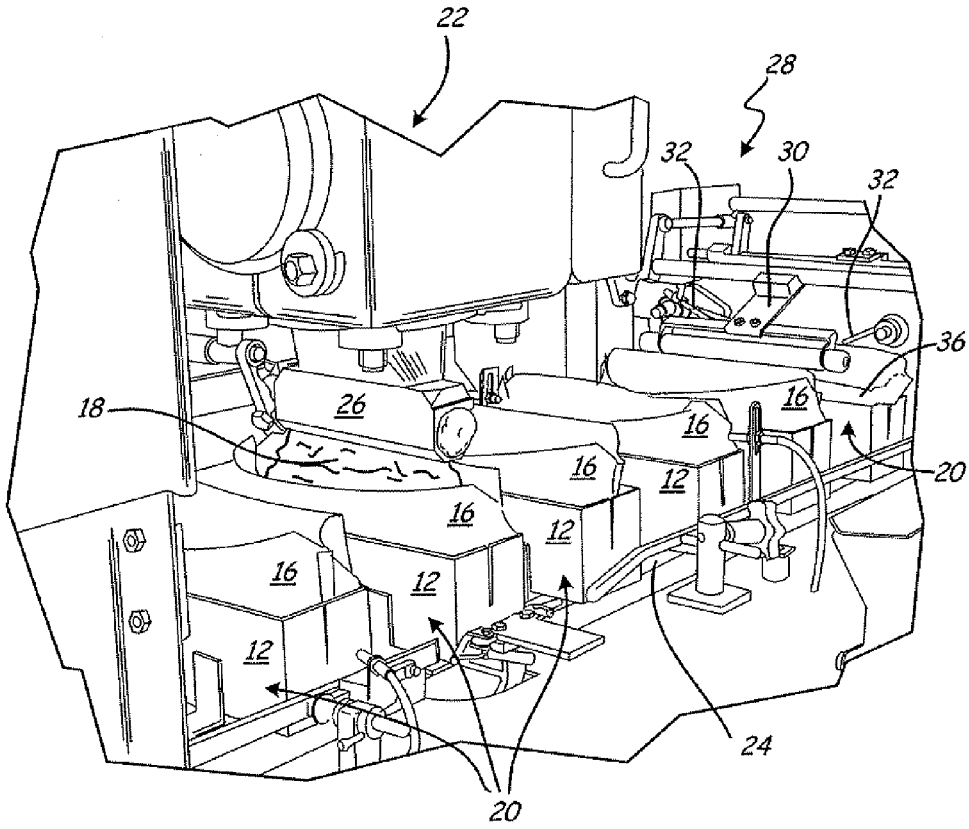
FIG. 2 is a perspective view of the cartons of FIG. 1 having pouches inserted therein, the pouches being filled with molten cheese product.

The food packaging system may include a pouch insertion system. In one exemplary embodiment, FIG. 2 is a perspective view of the cartons 12 of FIG. 1 having pouches 16 inserted therein. The pouches can be made from the polymeric film as described above. If cartons 12 are detected, the pouches 16, formed as discussed above, are advanced to the inserter area. In the inserter area, a plunger ram block inserts an opened pouch 16 into each carton 12. Each pouch 16 includes a floor and side walls formed from the stock non-wax-coated film. To make sure the pouch 16 is inserted properly, the plunger ram block flares out with use of air cylinders as it is inserted. In other words, a pulsed air blower may be provided on the plunger to reduce the tendency of pouches 16 to be pulled back out of the carton 12 when the plunger is retracted. The plunger ram retracts and releases the pouch 16 into the carton 12. The pouched carton 20 then passes through a reject station. In this station, if a pouch 16 is not detected, the empty carton 12 is blown off by an air blast.

The pouch 16 has a rectangular bottom that closely fits the inside dimensions of the formed carton 12. In an exemplary embodiment, the pouch 16 has no creases or film wrinkles. In an exemplary embodiment, the inserted pouches 16 remain erect in all four floor corners of the carton 12.

In some embodiments, the pouched carton 20 is then indexed to the pouch flaring station to open the top of the pouch 16. The flaring unit is a vertically reciprocating unit with flare fingers or rods that extend downward toward the interior of pouch 16. After flaring, the flared, pouched carton 20 is indexed to the filling station 22. Defective pouches 16 or cartons 12 are detected and rejected prior to the filling station 22.

The food packaging conveyor system may also include a pouch filling station. In an exemplary embodiment, the filling conveyor 24 is a single lane lugged chain conveyor that indexes the pouched cartons 20 through the various stages of the filling station 22. A servo motor drives the filling conveyor 24. A main AC motor drives the forming ram and filler head 26.

In an exemplary embodiment, the pouch filling unit 26 is a mechanically powered single piston that measures product 18 by volume. The filler head 26 has three basic functions in its operation. All three of these functions are achieved in tandem through the use of a combination shaft mounted cam/pneumatic cycle. The first function is a fill piston reciprocation. The linkage contains a screw adjustment that can regulate the amount of fill piston travel, thus changing the volume of product 18. This adjustment can be accomplished manually through the operator control panel or automatically through a continual feedback loop when tied to a high speed scale and adjusted automatically from the weighed packages.

The second function is a rotary spool valve located in the hopper base. It permits product flow from the hopper into the piston-cylinder on the suction stroke. Upon actuation, the valve allows the product 18 to be pumped down through the nozzle. A photoeye sensor mounted ahead of the filling station 22 senses a pouched carton 20. It engages a "no-fill" feature if the sensor fails to sense a pouched carton 20. The third function utilizes an air cylinder to activate the rotary valve on the nozzle. Once the valve opens, the cheese product 18 is filled into the pouched carton 20.

Figure 3A:
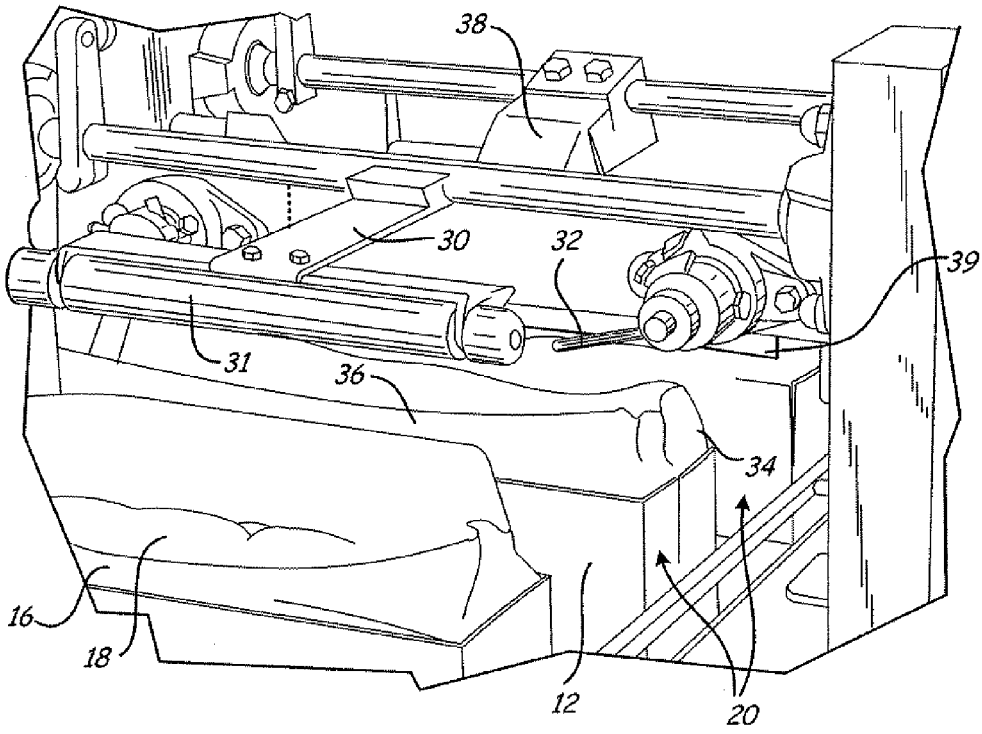
FIG. 3A is a perspective view of an assembly of a first sweeper arm and a pair of rocker arms disposed over a carton having a pouch therein filled with molten cheese product.
Figure 3B:
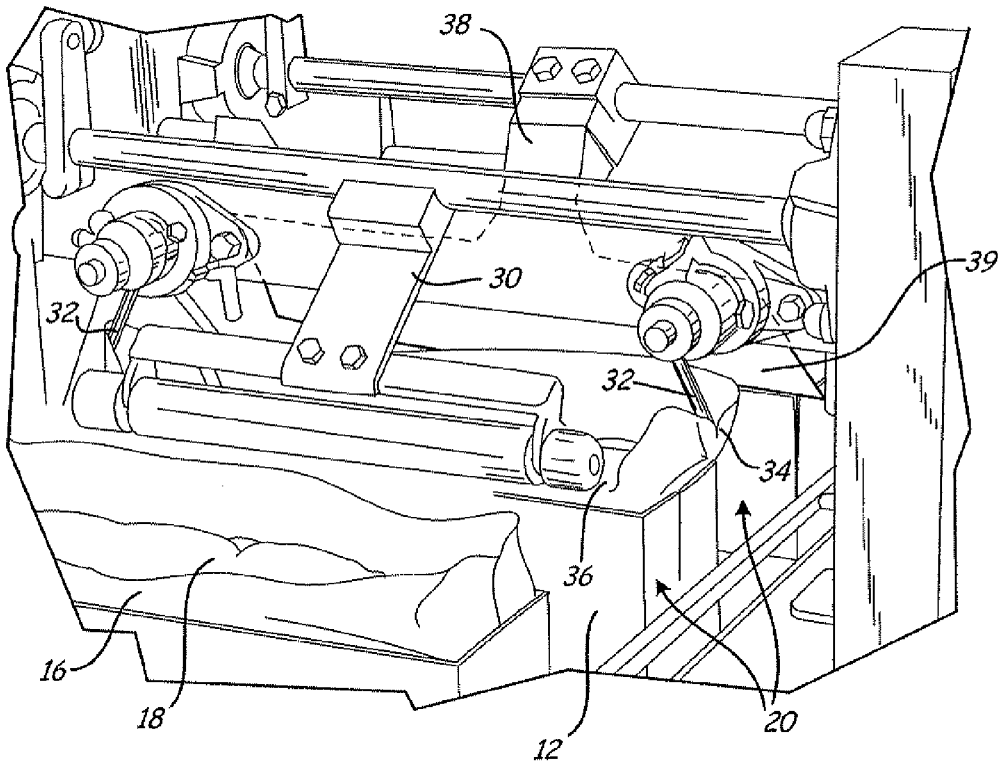
FIG. 3B is a perspective view of a first sweeper arm folding down one side of a top portion of a pouch and a pair of rocker arms pulling out the ears of the pouch.

In some embodiments, the food packaging system may include a pouch folding station. In one exemplary embodiment, once filled, the pouched carton 20 moves forward to the pouch folding station 28. FIG. 3A is a perspective view of an assembly of a first sweeper arm 30 with roller 31 and a pair of rocker arms 32 disposed over a pouched carton 20 filled with molten cheese product 18. FIG. 3B is a perspective view of first sweeper arm 30 folding down one side 36 of a top portion of a pouch 16 with roller 31. Simultaneously, a pair of rocker arms 32 pulls out the ears 34 of the pouch 20. As roller 31 of first sweeper arm 30 folds down a first side 36 of the top portion of the pouch 16 over the top of the cheese product 18, the first side 36 of the pouch film sticks to the cheese product 18.

Second sweeper arm 38 is positioned behind the assembly of rocker arms 32. In an exemplary embodiment, plate 39 is attached at an end of second sweeper arm 38 to flatten the cheese product 18 and smooth the first side 36 of the pouch film on the pouched carton 20 in the next index position. In an exemplary embodiment, each of first sweeper arm 30, second sweeper arm 38, and the pair of rocker arms 32 pivots between the positions shown in FIGS. 3A and 3B.

In an exemplary embodiment, the pivotal motion of first sweeper arm 30 and second sweeper arm 38 is coordinated so that they move together. Thus, both first sweeper arm 30 and second sweeper arm 38 are in an "up" position in FIG. 3A and both first sweeper arm 30 and second sweeper arm 38 are in a "down" position in FIG. 3B. In an exemplary embodiment, first sweeper arm 30 and second sweeper arm 38 simultaneously act upon two adjacent pouched cartons 20.

With first sweeper arm 30, second sweeper arm 38 and pair of rocker arms 32 in the position shown in FIG. 3A, pouched cartons 20 are indexed through pouch folding station 28. The film of each pouched carton 20 is folded as first sweeper arm 30 and pair of rocker aims 32 pivot to the positions shown in FIG. 3B. First sweeper arm 30 and pair of rocker arms 32 alternate between the positions shown in FIGS. 3A and 3B as the plurality of pouched cartons 20 index through pouch folding station 28. In the next index position, the pouched carton 20 then is contacted by plate 39 of second sweeper arm 38 to flatten and smooth the first side 36 of the pouch film.

Figure 3C:
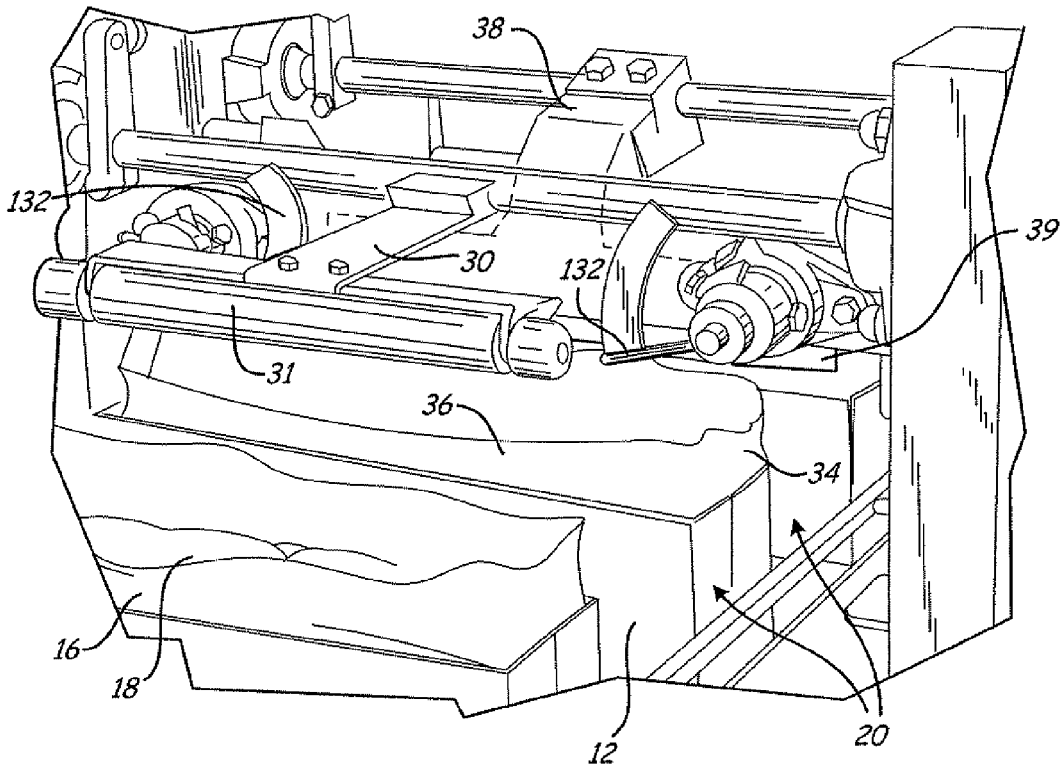
FIG. 3C is similar to FIG. 3A but shows another embodiment of a rocker arm.
Figure 3D:
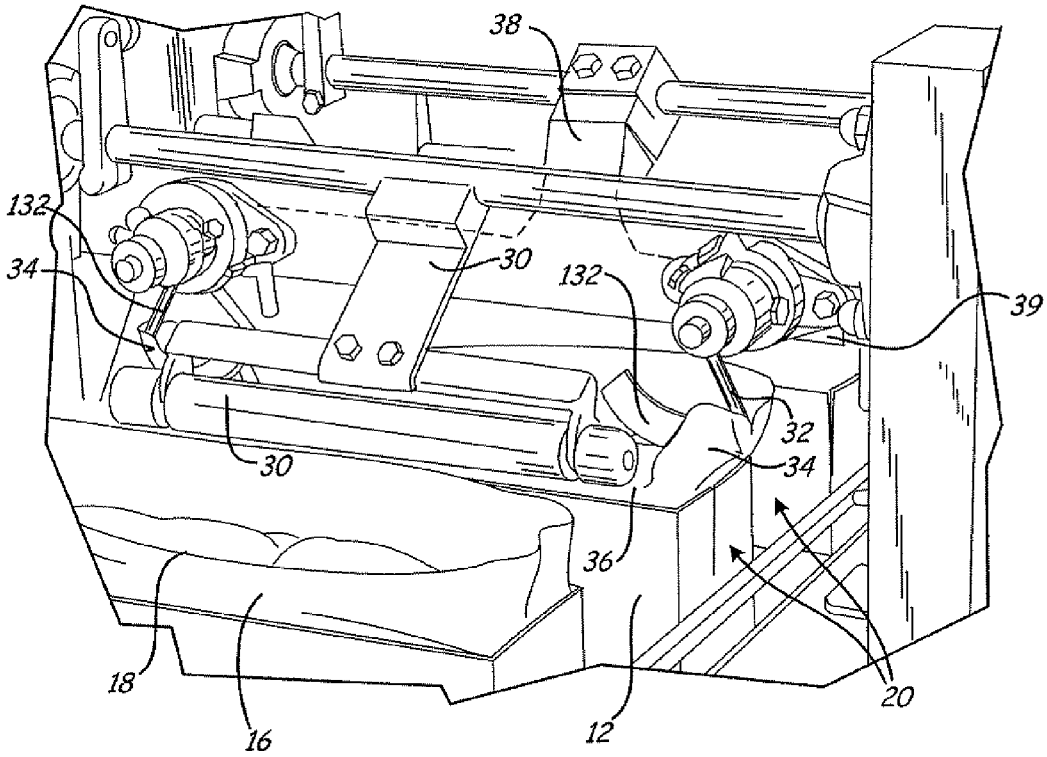
FIG. 3D is similar to FIG. 3B but shows the rocker arm of FIG. 3C.

FIG. 3C is similar to FIG. 3A but shows a sickle shaped embodiment of a rocker arm 132. FIG. 3D is similar to FIG. 3B but shows a sickle shaped embodiment of a rocker arm 132. The shape of sickle rocker arms 132 assists in flaring out ears 34 of pouch 16, thereby leading to more uniform shaping of ears 34.

Figure 4:
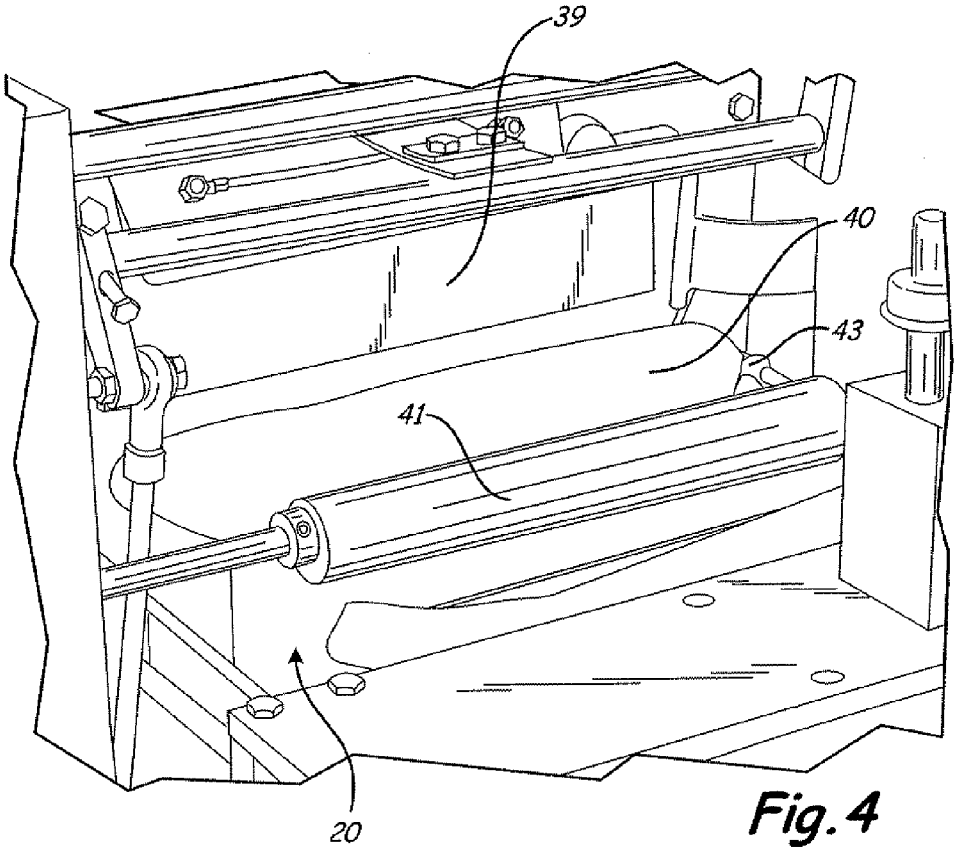
FIG. 4 is a perspective view of a guide folding down the other side of a top portion of a pouch.

FIG. 4 is a perspective view of a guide 41 folding down the second side 40 of a top portion of a pouch 16. In an exemplary embodiment, guide 41 is connected to pouch folding station 28 at pivotal connection 43, which allows some vertical movement of a bottom surface of guide 41 to accommodate irregularities in the filling of cheese product 18. While guide 41 is depicted as a roller, it can also be a plate or other member, preferably one that allows for vertical motion of its bottom surface. After this step, a portion of the second side 40 overlaps the first side 36 of the top portion of the pouch 16, thereby forming a top wall over cheese product 18. A guide plate may be used to keep the top wall flat before the sealing station 42.

Figure 5:
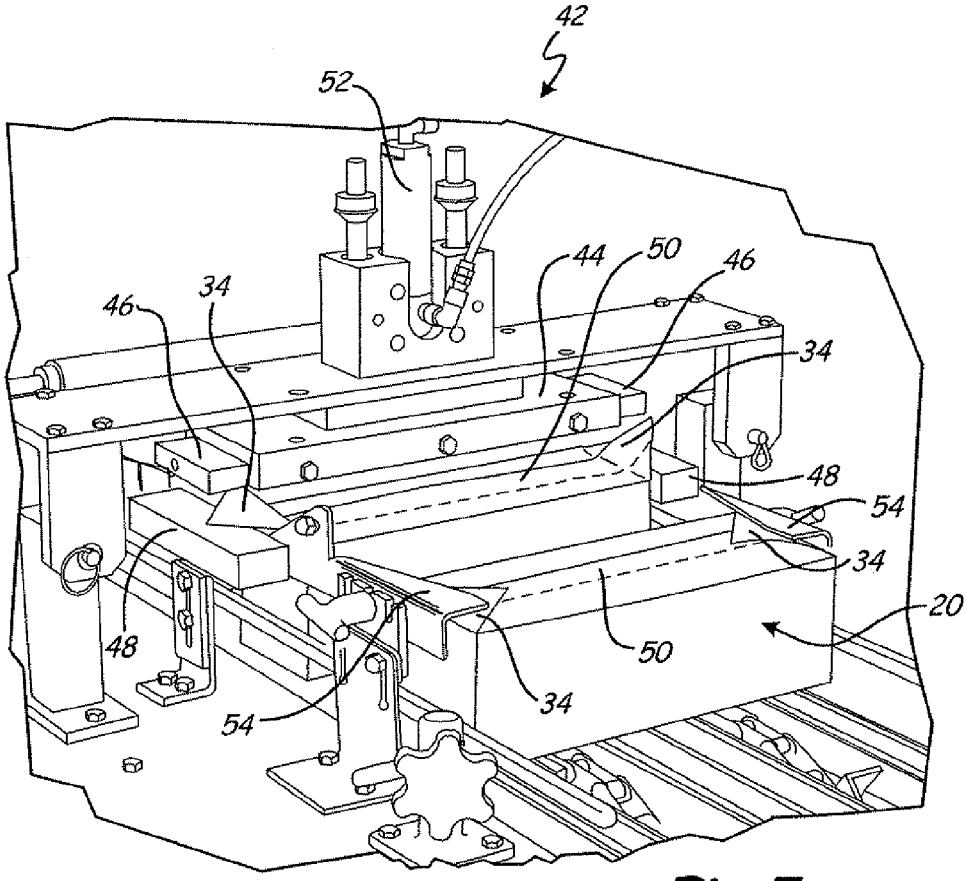
FIG. 5 is a perspective view of a tamper in a raised position above a pouch.

The food packaging system of the present invention includes a sealing station. In an exemplary embodiment, the folded pouch is then sent to a sealing station 42. FIG. 5 is a perspective view of a tamper 44 in a raised position above a pouch 16. A function of tamper 44 is to push down on overlap 50, expel trapped air from the headspace of the pouch 16, and apply heat through a conductive element, such as a wire, to seal portions of the film in the area of overlap 50. In an exemplary embodiment, tamper 44 is a platen having on its bottom surface a conductive element such as a wire through which an electrical impulse may be sent. Tamper 44 may be constructed to operate like a laboratory model hand-held electrical impulse sealer, available commercially as the "Traco Portable Wand Supersealer." Such a sealer has a conductive wire with a diameter of 0.0375" made of nichrome, through which an electrical impulse is sent to heat the wire. The wire is disposed over a piece of high-release material such as Teflon to prevent molten material from sticking to the sealer. The diameter of the wires that can be used as conductive elements can vary. Generally, the wires can be about 0.25 inch or smaller. Preferably, the diameter of the wires can be about 0.125 inch or smaller. More preferably, the diameter of the wires can be about 0.08 inch or smaller.

In an exemplary embodiment, the sealer is used at a setting of "3.5" or "4," thereby producing an electrical impulse that lasts about 1.5 seconds. This produces a temperature of about 161° C. (322° F.) at the sealing wire.

Figure 6:
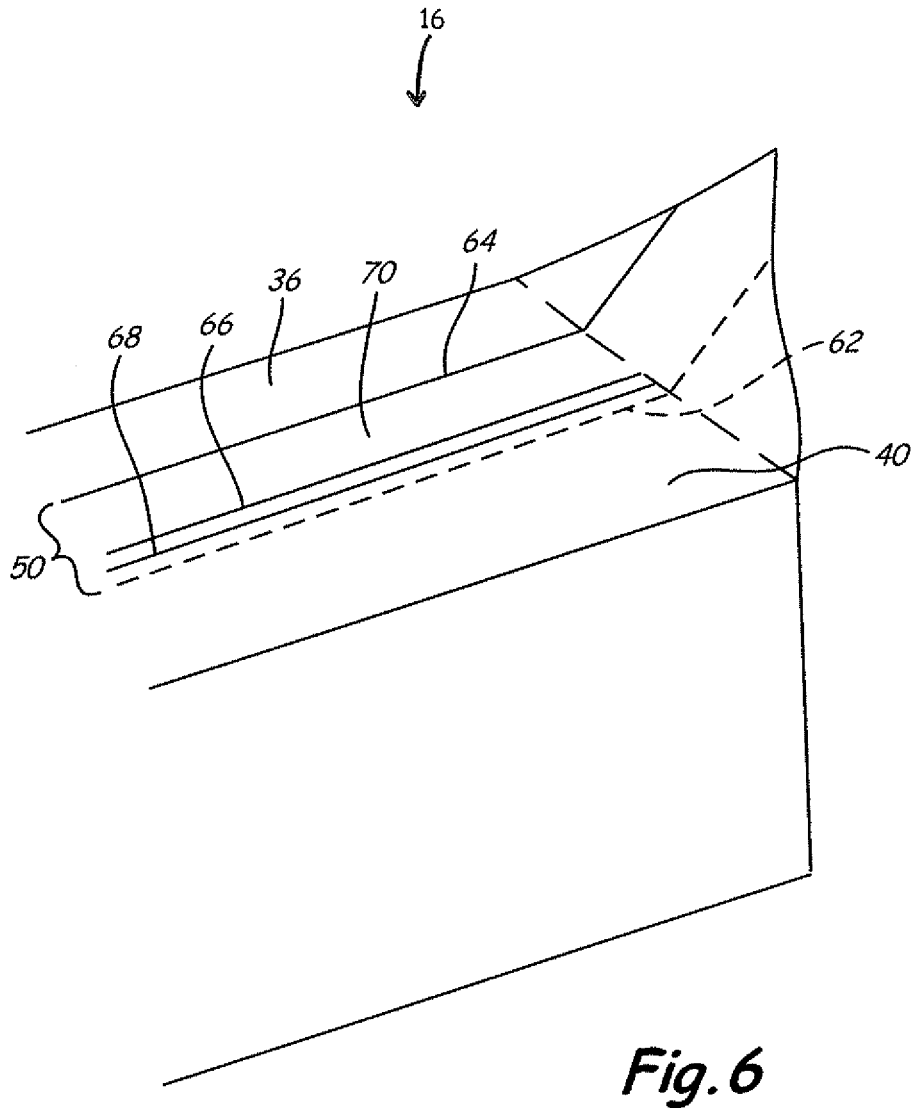
FIG. 6 is a partial perspective view of a cheese loaf having an overlapped seal of the present disclosure.

As shown in FIG. 6, overlap 50 is produced by the overlap of second side 40 over first side 36 of the top portions of pouch 16 over product 18. First side 36 of the top portion of pouch 16 terminates at edge 62. Second side 40 of the top portion of pouch 16 terminates at edge 64. Thus, overlapping region 50 is created between edges 62 and 64. Pouch 16 is formed so that the sealant side of the film on first side 36 is placed in contact with the substrate side of the film on second side 40. In an exemplary embodiment, overlap 50 is sealed by placing a tamper having a conductive wire longitudinally along the overlap and activating the wire to produce heat, which results in a sealed line, such as along first seal line 66. In an exemplary embodiment, a second parallel sealed line may also be made, such as along second seal line 68. Using an additional seal line adds redundancy, thereby better sealing pouch 16. In one embodiment, the distance between seal lines 66 and 68 is about 0.25 inch. The second seal line may be produced at the same time as the first seal line by equipping a tamper with a second conductive element. Thus, both the conductive elements can be activated at the same time and the two seal lines made simultaneously. Alternatively, the second seal may be made after the first seal line by moving the tamper a desired distance and then reactivating the conductive element to form the second seal line.

In an exemplary embodiment, tamper 44 has 2 parallel sealing wires disposed thereon so that both seal lines 66, 68 may be formed in a single step. Because heat is applied to only very narrow areas of film, specifically only at seal lines 66 and 68, there is virtually no distortion or wrinkling of the film. Moreover, significant energy savings may be achieved by heating only the very thin conductive elements and only for short impulses of time.

The disclosed method also results in an unsealed flap 70 between first seal line 66 and edge 64. The first seal line as used with reference to the unsealed flap can refer to seal line that is closest to edge 64 and not necessarily to the seal line produced first temporally. This unsealed flap 70 allows for easy opening of pouch 16, as the user has adequate space for gripping flap 70 and pulling side 40 up to break the seal at seal lines 66 and 68. Thus, the disclosed method results in a continuous, peelable hermetic seal.

As shown in FIG. 5, in an exemplary embodiment, tamper 44 includes extensions for heated upper ear anvils 46. Ears 34 of pouch 16 extend between upper ear anvil 46 and lower ear anvil 48. In an exemplary embodiment, both upper ear anvil 46 and lower ear anvil 48 are heated, so that each ear 34 is sealed with heat from both the top and bottom sides of the ear 34. Because pressure is provided on both sides of the ear 34, a lower sealing temperature may be used compared with the temperature of tamper 44. The temperature of heated ear anvils 46, 48 is generally in the range of approximately 250-275° F. in one embodiment. In an exemplary embodiment, ear guides 54 fold down ears 34 as pouched cartons 20 are indexed past ear guides 54.

Figure 7:
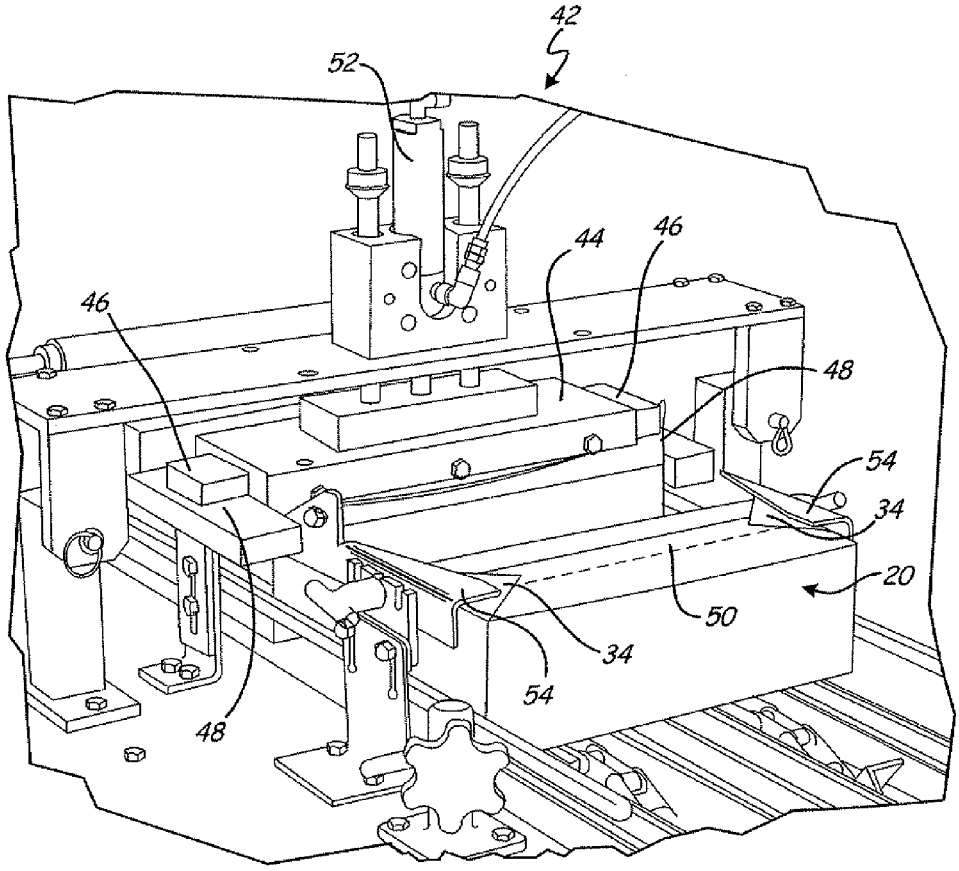
FIG. 7 is a perspective view of a tamper in a lowered, sealing position on a pouch.

FIG. 7 is a perspective view of a tamper 44 in a lowered, sealing position on pouch 16. The tamper 44 is actuated by means of an air cylinder 52. In an exemplary process, tamper 44 is in the raised position shown in FIG. 5 as pouched cartons 20 are indexed through sealing station 42. When an unsealed pouched carton 20 is positioned under tamper 44, tamper 44 is actuated to press down on lap seal 50 and ears 34, as shown in FIG. 7. In the lowered position, an electrical impulse is sent through the conductive wire(s) to form the sealing line(s). Tamper 44 is then raised to allow for indexing of the next pouched carton 20.

Figure 8:
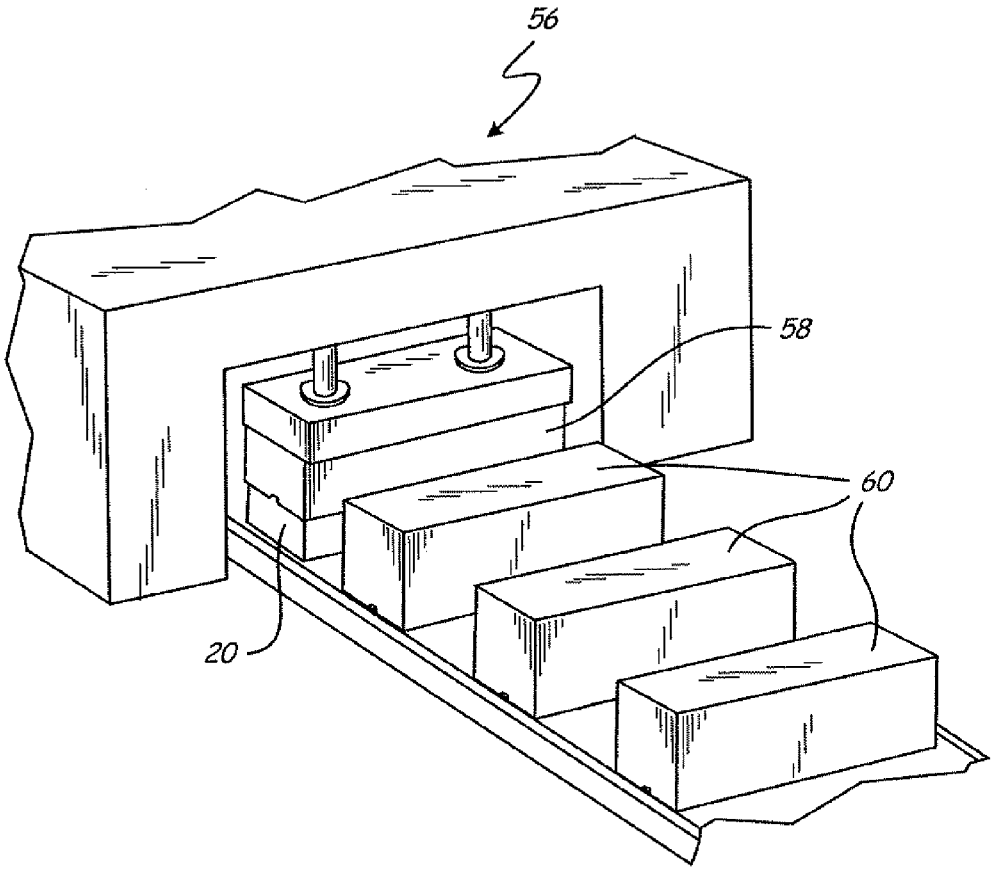
FIG. 8 is a perspective view of a lidding operation for sealed pouches within cartons.

The pouched cartons 20 are then discharged to a lidding operation, in which a lid is positioned over the top of the pouched carton 20. FIG. 8 is a perspective view of a lidding station 56 for applying lids 58 to sealed, pouched cartons 20 to form packages 60. In the illustrated embodiment, the lids 58 are pre-foamed. In another embodiment, the lids are provided as flat blanks that are then folded and glued to the pouched carton 20 on-line. In an exemplary method, a flat lid blank is positioned over a pouched carton 20 as the carton 20 is raised to meet the lid. As the pouched carton 20 continues to move upward, the sides of the lid are bent down over the pouched carton 20. The lid is glued to the pouched carton 20 with hot-melt adhesive.

The present disclosure also includes a method of forming a lap seal for a pouch containing food product. In preferred embodiments, the pouch is made from the polymeric film described above. The method can include placing a tamper having at least one conductive element on top of overlapping film layers of a pouch. The tamper is generally placed longitudinally along the top edge. Generally, the top edges of the pouch have been folded appropriately to generate overlapping layers. The method also includes activating the conductive element to emit an electrical impulse that generates heat. The heat from the electrical impulse through the conductive element can form a seal line. The conductive elements can be as described above. The electrical impulse can last for a duration between about 0.1 seconds and about 5 seconds. Preferably, the electrical impulse has a duration of between about 0.5 seconds and about 3.0 seconds.

The method may also include the use of a tamper having multiple conductive elements. In one exemplary method, the tamper can include two conductive elements and when these conductive elements are activated, the generated heat forms two sealed lines corresponding to the two conductive elements. The distance between the two seal lines can vary. In some exemplary embodiments, the distance between the two sealed lines is about 0.25 inches. Embodiments in which the distance is between about 0.25 inches and about one inch are also contemplated. Distances outside of these ranges are also within the scope of this invention. This method of forming a lap seal also results in an unsealed flap that can be formed from the film edge of the lap seal to the first seal line. Lifting of the unsealed flap can enable the user to easily open the pouch when desired.

In some embodiments, the present disclosure also includes a method of packaging food, particularly in horizontal pouch forming equipment. The method can include placing a pouch in an enclosure, filling the pouch with food product, folding the pouch and sealing the pouch with an electrical impulse emitted by a conductive element while in contact with an overlapping region of the pouch. This method is described above and embodiments are illustrated in FIGS. 1-8. A variety of food product may be packaged using these methods. Food product such as cheese, cheese products and other viscous food product can be packaged using the methods described herein.

In some embodiments, the present disclosure also includes food packages that are pouches or include a pouch. The pouches generally have a lap seal with at least one seal line generated by an electrical impulse going through the overlap area of the pouch_The food packages may be produced in a production line system. The pouches may also include a lap seal having two seal lines. The second seal line is generally parallel to the first seal line in the overlap area of the pouch. The pouches generally comprise polymeric film as described above. Advantageously, the pouches sealed with the methods described herein are generally not distorted or wrinkled upon sealing due to the low amount of heat that is used for sealing. The polymeric packaging film amenable for use in food packaging preferably has a low heat activation. In one exemplary embodiment, the film can seal at about 220° F.

Although the disclosure refers to exemplary embodiments, workers skilled in the art will recognize that changes may be made in form and detail without departing from the spirit and scope of the invention.

The invention claimed is:

1. A method of forming a lap seal comprising:

providing a film surrounding a food product, the film having overlapping edges forming an overlap area, the overlap area overlying the food product;

providing a tamper comprising a surface facing the overlap area and a conductive element disposed along a portion of the surface;

positioning the tamper against the overlap area such that the overlap area is compressed against the food product and the conductive element is adjacent the overlap area; and heating the conductive element to form a seal line of the lap seal between the overlapping edges in the overlap area.

2. The method of claim 1 wherein the conductive element comprises a wire.

3. The method of claim 1 wherein the tamper comprises a second conductive element and the heating forms two sealed lines.

4. The method of claim 3 wherein the two seal lines are substantially parallel to each other.

5. The method of claim 3 wherein a distance between the two seal lines is about 0.25 inch.

6. The method of claim 1 further comprising:

moving the tamper from the first seal line to a second position; and heating the conductive element to form a second seal line of the lap seal.

7. The method of claim 1 wherein the overlap area is elongated, the conductive element is elongated and the tamper is placed longitudinally along the overlap area.

8. The method of claim 1 wherein an unsealed flap is formed between an overlapping film edge and the seal line.

9. The method of claim 1 wherein the conductive element is heated intermittently.

10. The method of claim 1 wherein the seal line formed in the overlap area has a width of less than about 0.25 inch.

11. The method of claim 1 wherein the conductive element is disposed on a bottom surface of the tamper.

12. The method of claim 1 wherein the heating is provided by an electrical impulse.

13. The method of claim 1 further comprising intermittently heating the conductive element from between 0.1 and 5 seconds before deactivating during the intermittent heating.

14. A method of forming a lap seal comprising:

loading a food product into a non-wax coated polymeric film package forming an opening such that the package surrounds the food product and is open at the opening;

folding first and second sides of the opening of the package over the food product to form an overlap area, the overlap area overlying the food product;

providing a tamper comprising a surface facing the overlap area and a conductive element disposed along a portion of the surface;

positioning the tamper against the overlap area such that the overlap area is compressed against the food product and the at least one conductive element contacts the overlap area, wherein the conductive element is adapted for intermittent heating, and wherein during positioning, the conductive element is inactive; and activating the conductive element thereby heating the conductive element and forming a seal line of the lap seal in the overlap area between the first and second sides of the overlapping non-wax coated polymeric film.

15. The method of claim 14 wherein the conductive element is activated from between 0.1 and 5 seconds before deactivating during the intermittent heating.

16. The method of claim 14 wherein the tamper comprises a release material overlying the conductive element.

17. The method of claim 16 wherein the conductive element comprises a conductive wire and the intermittent heating is via an electrical impulse through the conductive wire.

* * * * *

UNITED STATES PATENT AND TRADEMARK OFFICE

CERTIFICATE OF CORRECTION

PATENT NO. : 8,484,937 B1
APPLICATION NO. : 12/728438
DATED : July 16, 2013
INVENTOR(S) : Michael J. Gabriel It is certified that error appears in the above-identified patent and that said Letters Patent is hereby corrected as shown below:

ON THE TITLE PAGE:

Item (57) ABSTRACT

| Line | | Should Read |
|---|---|---|
| 1 | "This disclosure relates to foiiuing food packages" | --This disclosure relates to forming food packages-- |

IN THE SPECIFICATIONS:

| Column | Line | | Should Read |
|---|---|---|---|
| 4 | 3 | "foaming, filling and sealing" | -- forming, filling and sealing-- |
| 8 | 44 | "58 are pre-foamed." | --58 are pre-formed.-- |

Signed and Sealed this
Tenth Day of September, 2013

Teresa Stanek Rea
*Acting Director of the United States Patent and Trademark Office*